US008281622B2

(12) United States Patent
Pyo

(10) Patent No.: US 8,281,622 B2
(45) Date of Patent: Oct. 9, 2012

(54) DRUM WASHING MACHINE AND WASHING METHOD THEREOF

(75) Inventor: Sang Yeon Pyo, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 777 days.

(21) Appl. No.: 12/068,458

(22) Filed: Feb. 6, 2008

(65) Prior Publication Data

US 2008/0263783 A1 Oct. 30, 2008

(30) Foreign Application Priority Data

Apr. 24, 2007 (KR) ..... 10-2007-40060

(51) Int. Cl.
*D06F 37/06* (2006.01)

(52) U.S. Cl. ..... 68/5 C; 68/142; 68/213; 68/233

(58) Field of Classification Search ..... 68/5 C, 68/13 R, 142, 213, 233
See application file for complete search history.

(56) References Cited

U.S. PATENT DOCUMENTS

| | | | | |
|---|---|---|---|---|
| 2,305,695 | A * | 12/1942 | Hayes | 68/60 |
| 2,480,929 | A * | 9/1949 | Hyman | 34/108 |
| 2,651,509 | A * | 9/1953 | Hyman | 34/108 |
| 3,146,196 | A * | 8/1964 | Bochan et al. | 210/380.2 |
| 3,261,185 | A * | 7/1966 | Rihr | 68/213 |
| 4,771,615 | A * | 9/1988 | Fukuzawa et al. | 68/23 R |
| 6,795,995 | B1 | 9/2004 | Holbus | |
| 6,889,399 | B2 * | 5/2005 | Steiner et al. | 8/159 |
| 7,096,695 | B2 * | 8/2006 | No et al. | 68/58 |
| 7,481,005 | B2 * | 1/2009 | Bolduan et al. | 34/95 |
| 7,600,402 | B2 * | 10/2009 | Shin et al. | 68/5 C |
| 2003/0074932 | A1 * | 4/2003 | No et al. | 68/58 |
| 2003/0145408 | A1 * | 8/2003 | Kohlruss et al. | 15/209.1 |
| 2005/0069672 | A1 * | 3/2005 | Katsin | 428/88 |
| 2005/0092035 | A1 | 5/2005 | Shin et al. | |
| 2005/0217035 | A1 * | 10/2005 | Steiner et al. | 8/149.3 |
| 2006/0000241 | A1 * | 1/2006 | Rosenzweig | 68/5 R |
| 2006/0288600 | A1 * | 12/2006 | Taylor | 34/60 |

FOREIGN PATENT DOCUMENTS

| | | |
|---|---|---|
| CN | 2493636 | 5/2002 |
| JP | 11-057280 | 3/1999 |
| JP | 2000-135395 | 5/2000 |

OTHER PUBLICATIONS

Office Action in corresponding Japanese Application 2008-060143 (3 pp.).
Chinese Office Action dated May 17, 2011, issued in Chinese Patent Application No. 200810074064.0.
Chinese Office Action issued Nov. 27, 2009 in corresponding Chinese Patent Application 200810074064.9.

* cited by examiner

*Primary Examiner* — Joseph L Perrin
(74) *Attorney, Agent, or Firm* — Staas & Halsey LLP

(57) ABSTRACT

A drum washing machine and a washing method of the drum washing machine wash clothes to be dry-cleaned, without water, using microfiber. The drum washing machine includes a tub; a drum rotatably provided in the tub; and a cleaning member contacting laundry in the drum to perform the dry-cleaning of the laundry. The drum washing machine washes clothes to be dry-cleaned, without water, using a cleaning member made of microfiber, thereby minimizing the deformation or shrinkage of the clothes.

7 Claims, 7 Drawing Sheets

DRUM WASHING MACHINE AND WASHING METHOD THEREOF

CROSS-REFERENCE TO RELATED APPLICATIONS

This application claims the benefit of Korean Patent Application No. 2007-0040060, filed Apr. 24, 2007, in the Korean Intellectual Property Office, the disclosure of which is incorporated herein by reference.

BACKGROUND

1. Field

The present invention relates to a drum washing machine, and more particularly, to a drum washing machine, which washes clothes, to be dry-cleaned, without water.

2. Description of the Related Art

Generally, drum washing machines are apparatuses which wash laundry using the falling of water caused by rotating a drum. Each of the drum washing machines includes a housing forming an external appearance, a tub installed in the housing for containing water, a drum rotatably installed in the tub for containing laundry, a driving motor generating the rotary force of the drum, and a control panel provided on the upper part of the housing for manipulating a washing method according to the kind and amount of the laundry.

In a wet washing mode of a drum washing machine, a washing operation, a rinsing operation, and a dehydrating operation are sequentially carried out. When the washing operation is started under the condition that laundry is put into a drum, a water supply valve is switched on, and thus, washing water is supplied into a tub and the drum. Thereafter, the laundry is washed by rotating the drum using a driving motor so that lifters lift the laundry to a designated height, and then the laundry is dropped. When the washing operation is completed, a drain pump is operated, and thus, the washing water is drained. Then, a dehydrating operation is performed by rotating the drum at a high speed. When the dehydrating operation is completed, the water supply valve is opened again, and thus, washing water is supplied again into the tub and the drum. Thereafter, a rinsing operation is performed. After the rinsing operation is repeated, the last dehydrating operation is performed. Thereby, the wet washing of the laundry is completed.

In general, clothes as well as food and residences are inevitably vital to human beings. That is, clothes serve to keep off the cold and the heat and to protect the human body from various contaminants. Further, in society today, in which fashion is regarded as important, the maintenance and conservation of clothes is a matter of grave concern, and a neat and tidy appearance plays an important role in forming personal relations. Accordingly, it is important to maintain and conserve clothes hygienically by removing contaminants and bacteria from the clothes.

Some kinds of fiber shrink or expand when they contact water, and thus, clothes made of these kinds of fiber are deformed, napped, or seriously wrinkled and are not wearable after their contact with water. These clothes need to be dry-cleaned. The dry-cleaning method conserves the original state of the clothes and increases the durability of the fiber, compared with the wet washing method, thus lengthens the life span of the clothes.

In order to dry-clean clothes, the clothes must be sent to a dry-cleaner. Dry-cleaning charges are expensive, and thus, increase the customer's economic burden. In particular, the clothes of several persons are collected for dry-cleaning and are dry-cleaned all at once by the dry-cleaner, thus, potentially being unhealthy Accordingly, there is a need for a dry cleaning method in which clothes are simply refreshed using a general drum washing machine at home.

SUMMARY

Therefore, one aspect of the invention is to provide a drum washing machine, which washes clothes to be dry-cleaned, without water, and a washing method of the drum washing machine.

In accordance with one aspect, the present invention provides a drum washing machine comprising a tub; a drum rotatably provided in the tub; and a cleaning member contacting laundry in the drum to perform the dry-cleaning of the laundry.

The cleaning member may be made of microfiber.

The drum washing machine may further comprise at least one fixing unit for detachably attaching the cleaning member to the drum.

The at least one fixing unit may include a first fixing portion connected to the drum.

The at least one fixing unit may include second fixing portions to hold the cleaning member.

The drum may include lifters to move the laundry; and the first fixing portion may be inserted into a corresponding one of the lifters.

Each of the lifters may include a guide portion having a groove formed to a designated depth, and engaging holes formed in both ends of the guide portion to a designated depth; and the first fixing portion may include a first fixing body inserted into the corresponding one of the guide portions, and first engaging pieces inserted into the engaging holes.

The first fixing portion may be made of an elastic material.

Each of the second fixing portions may be formed in the shape of tweezers for holding the cleaning member.

The at least one fixing unit may be a plurality of fixing units.

The drum washing machine may further comprise a steam generator for supplying steam to the inside of the drum.

The drum washing machine may further comprise a hot air supply device for spraying hot air to the inside of the drum.

In accordance with another aspect, the present invention provides a dry-cleaning washing method of a drum washing machine, comprising determining whether a dry-cleaning mode is selected; switching on a first water supply valve to prevent washing water from flowing to the inside of a drum when it is determined that the dry cleaning mode is selected; and rotating the drum.

The dry-cleaning washing method may further comprise operating a steam generator simultaneously with the rotation of the drum, to supply steam.

The dry-cleaning washing method may further comprise determining whether a dry-cleaning washing time is in a drying time range; and operating a hot air supply device to spray hot air when it is determined that the dry-cleaning washing time is in the drying time range.

Additional aspects and/or advantages will be set forth in part in the description which follows and, in part, will be apparent from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings in which.

DETAILED DESCRIPTION OF THE EMBODIMENTS

Figure 1:
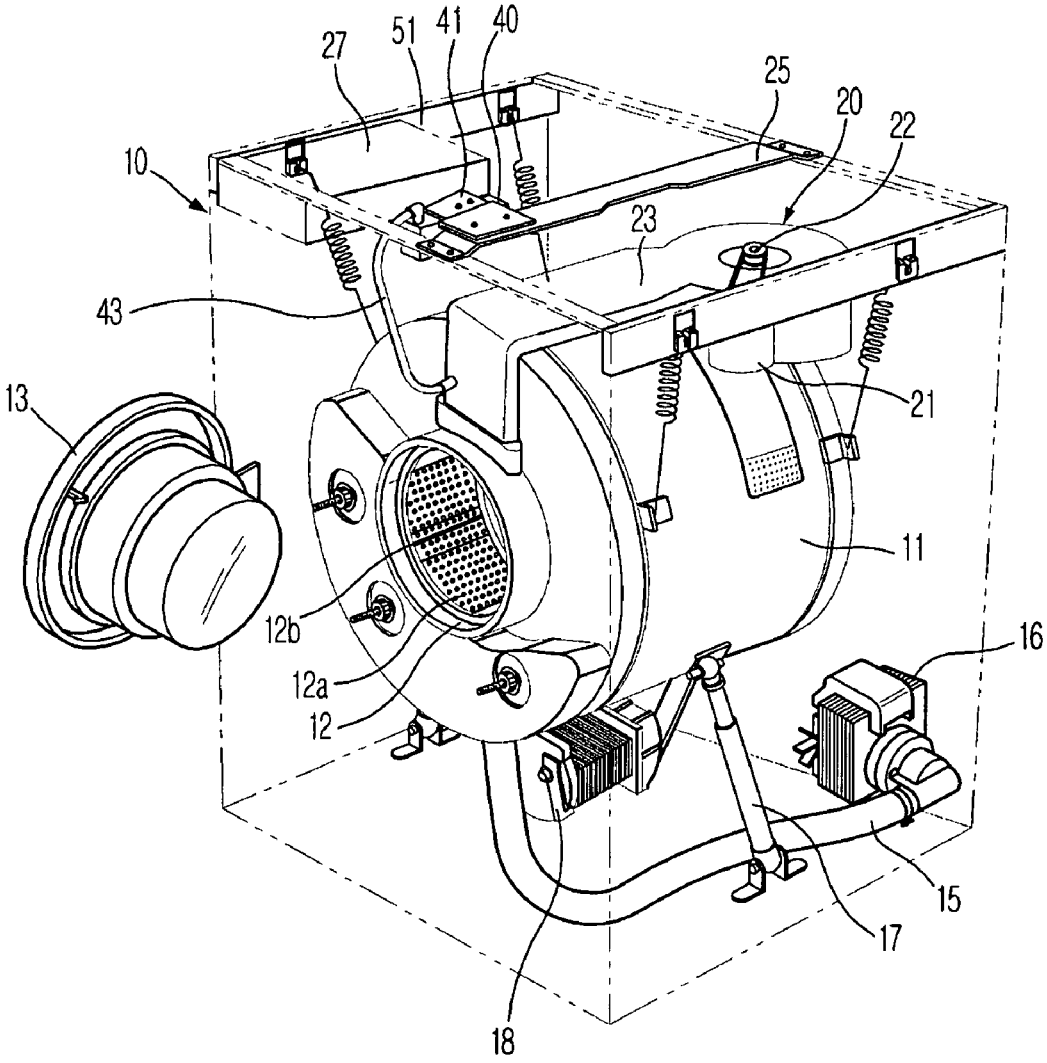
FIG. 1 is a perspective view of a drum washing machine in accordance with an embodiment of the present invention.

Reference will now be made in detail to the embodiments of the present invention, examples of which are illustrated in the accompanying drawings, wherein like reference numerals refer to like elements throughout. The embodiments are described below to explain the present invention by referring to the drawings.

FIG. 1 is a perspective view of a drum washing machine in accordance with an embodiment of the present invention.

Figure 2:
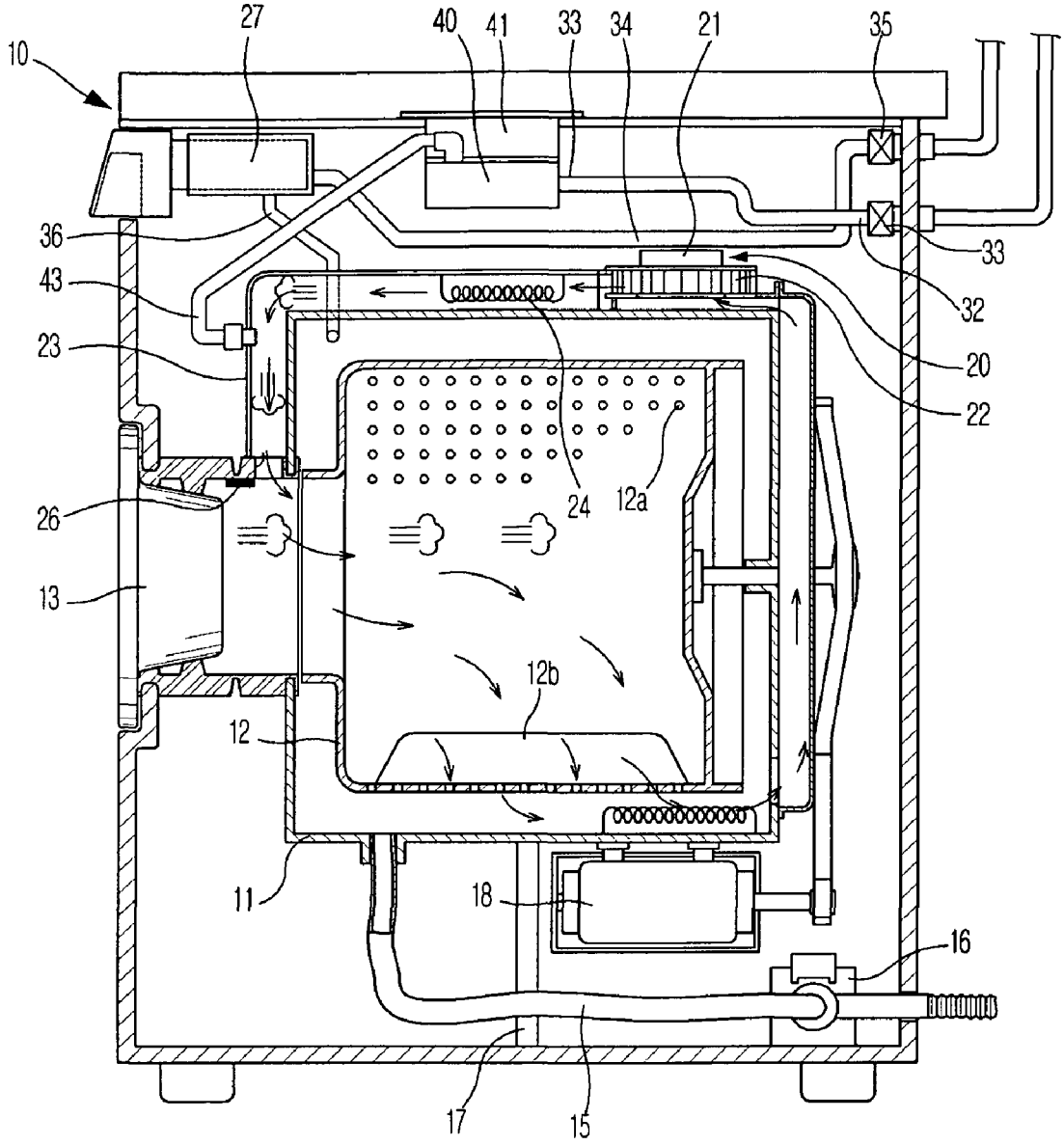
FIG. 2 is a longitudinal sectional view of the drum washing machine in accordance with an embodiment of the present invention.

FIG. 2 is a longitudinal sectional view of the drum washing machine in accordance with an embodiment of the present invention.

As shown in FIGS. 1 and 2, the drum washing machine of the present invention includes a housing 10 forming an external appearance of the washing machine, a cylindrical tub 11 provided in the housing 10, a cylindrical drum 12 rotatably installed in the tub 11 for containing laundry, a driving motor 18 generating a rotary force of the drum 12, and a control panel (not shown) provided on an upper part of the housing 10 for manipulating a washing method according to a kind and amount of the laundry. A steam generator 40 for supplying steam to the inside of the drum 12 is provided above the tub 11, and a hot air supply device 20 for spraying hot air to the inside of the drum 12 is provided above the drum 12.

Openings are respectively formed through front surfaces of the tub 11 and the drum 12 so that a user can put laundry into, and take laundry out of, the drum 12 through the openings of the tub 11 and the drum 12. A door 13 for opening and closing the openings of the tub 11 and the drum 12 is hinged to one side of the front surface of the housing 10.

A drain pipe 15 and a drain pump 16 for draining the washing water to the outside of the washing machine and a suspension device 17 for absorbing vibration generated due to the rotation of the drum 12 and supporting the tub 11 are connected to the lower part of the tub 11.

A first water supply device for supplying washing water to the inside of the tub 11 and a second water supply device for supplying water to the inside of the steam generator 40 are provided above the tub 11. The first water supply device includes a first water supply pipe 34 to connect an external water supply source (not shown) and a detergent supply device 27, a washing water supply pipe 36 to connect the detergent supply device 27 and the tub 11, and a first water supply valve 35 to control the opening and closing of the first water supply pipe 34. The second water supply device includes a second water supply pipe 32 to connect the external water supply source (not shown) and the steam generator 40, a steam supply pipe 43 connected to the steam generator 40 to transfer the steam to the drum 12, and a second water supply valve 33 to control the opening and closing of the second water supply pipe 32.

The drum 12 is rotated by the rotary force generated by the driving motor 18 installed in a lower part of the housing 10, and through holes 12*a* are formed through the circumferential surface thereof so that water can flow into and out of the drum 12 via the through holes 12*a*. A plurality of lifters 12*b*, which protrude from the inner surface of the drum 12, lift the laundry, and then drop the laundry, thus allowing the laundry to be washed using a difference in elevation.

A support plate 25 connecting the central regions of the front and rear parts of the housing 10 is installed on the upper surface of the housing 10. The steam generator 40 is mounted on the support plate 25 using a bracket 41. The steam generator 40 heats water using a heater (not shown) to change the state of the water, thereby generating steam. The steam generated from the steam generator 40 is sprayed on the inside of the drum 12 in a washing operation, and thus sterilizes and disinfects the laundry, soaks dirt of the laundry to effectively wash the laundry, and reduces the degree of wrinkling of the laundry.

The second water supply pipe 32 to supply water to the steam generator 40 is connected to one end of the steam generator 40. The steam supply pipe 43 is connected to the other end of the steam generator 40 so that the steam generated from the steam generator 40 can be supplied to the inside of the tub 11, thus connecting the steam generator 40 and a drying duct 23.

A temperature sensor 26 to sense the internal temperature (T) of the drum 12 is provided at an outlet of the drying duct 23 to control spraying the steam into the drum 12. The internal temperature (T) of the drum 12 sensed by the temperature sensor 26 is compared with a predetermined temperature (Tset), which is input in advance by a user, and the switching-on and switching-off of the second water supply valve 33 is controlled according to a result of the comparison. That is, when the internal temperature (T) is not lower than the predetermined temperature (Tset) ($T \geqq Tset$), the second water supply valve 33 is controlled, and thus, closes the second water supply pipe 32 such that water is not supplied to the steam generator 40. Further, when the internal temperature (T) is lower than the predetermined temperature (Tset) ($T < Tset$), the second water supply valve 33 is controlled, and thus, opens the second water supply pipe 32 such that water is supplied to the steam generator 40.

The hot air supply device 20, to supply hot air to the inside of the drum 12 to dry the laundry rapidly after the washing operation is completed, is provided above the drum 12. The hot air supply device 20 includes a motor 21 generating power, a fan 22 connected to the motor 21 and rotated, and the drying duct 23 to guide air supplied by the rotary force of the fan 22. A heater 24 to heat the air supplied by the rotary force of the fan 22 is installed in the drying duct 23. The drying duct 23 communicates with the upper part of the front surface of the tub 22, and thus, supplies the hot air heated by the heater 24 to the tub 11. Then, the laundry in the drum 12 is dried by the hot air, while rotating.

Figure 3:
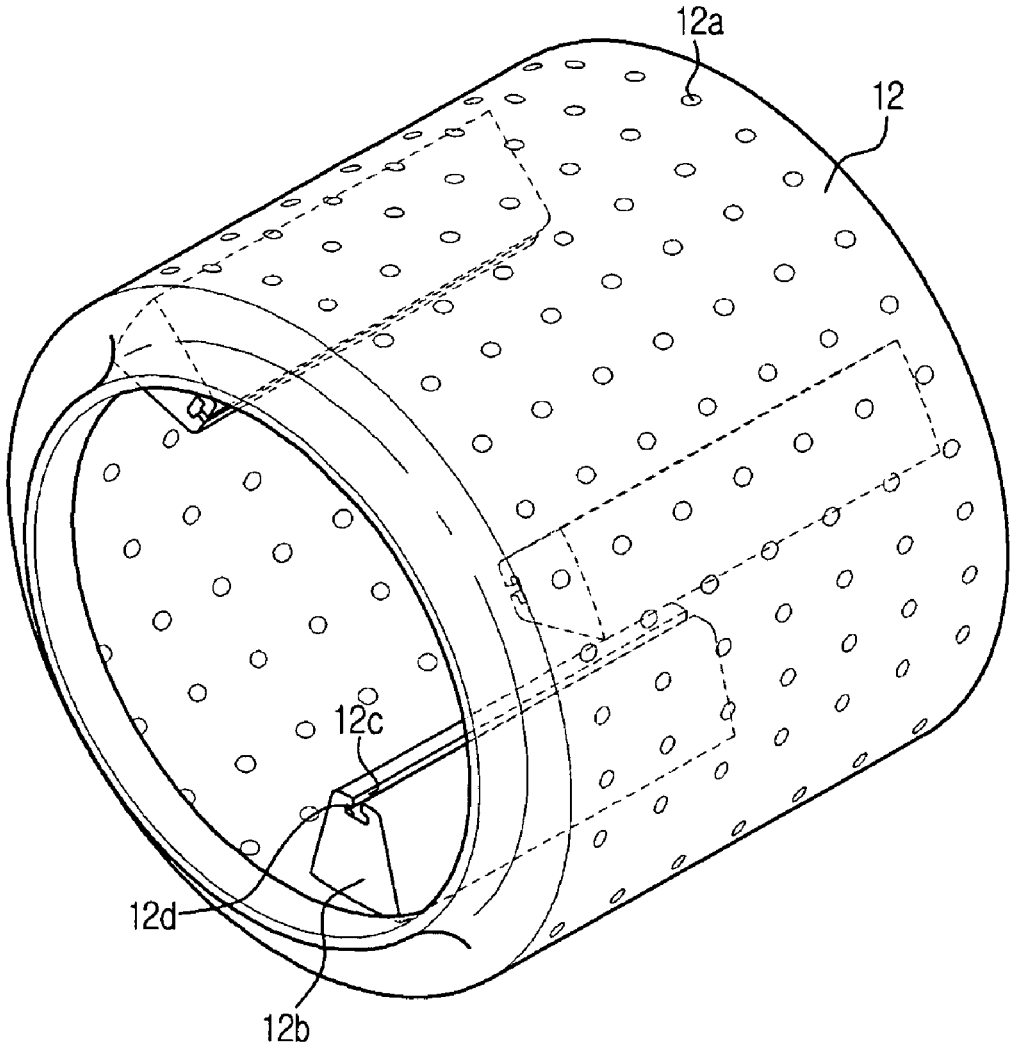
FIG. 3 is a perspective view illustrating guide portions of lifters of the drum washing machine in accordance with an embodiment of the present invention.

FIG. 3 is a perspective view illustrating guide portions of the lifters of the drum washing machine in accordance with an embodiment of the present invention.

The lifters 12*b* to lift the laundry are provided in the drum 12. A plurality of the lifters 12*b*, which are disposed at regular intervals, is installed on the inner wall of the drum 12. Each of the lifters 12*b* includes a guide portion 12*c* having a groove with a designated depth in the longitudinal direction, and engaging holes 12*d* formed in both ends of the guide portion 12*c* with a designated depth in a direction perpendicular to the groove of the guide portion 12*c*. The engaging holes 12*d* are symmetrical with respect to the guide portion 12*c*.

Figure 4:
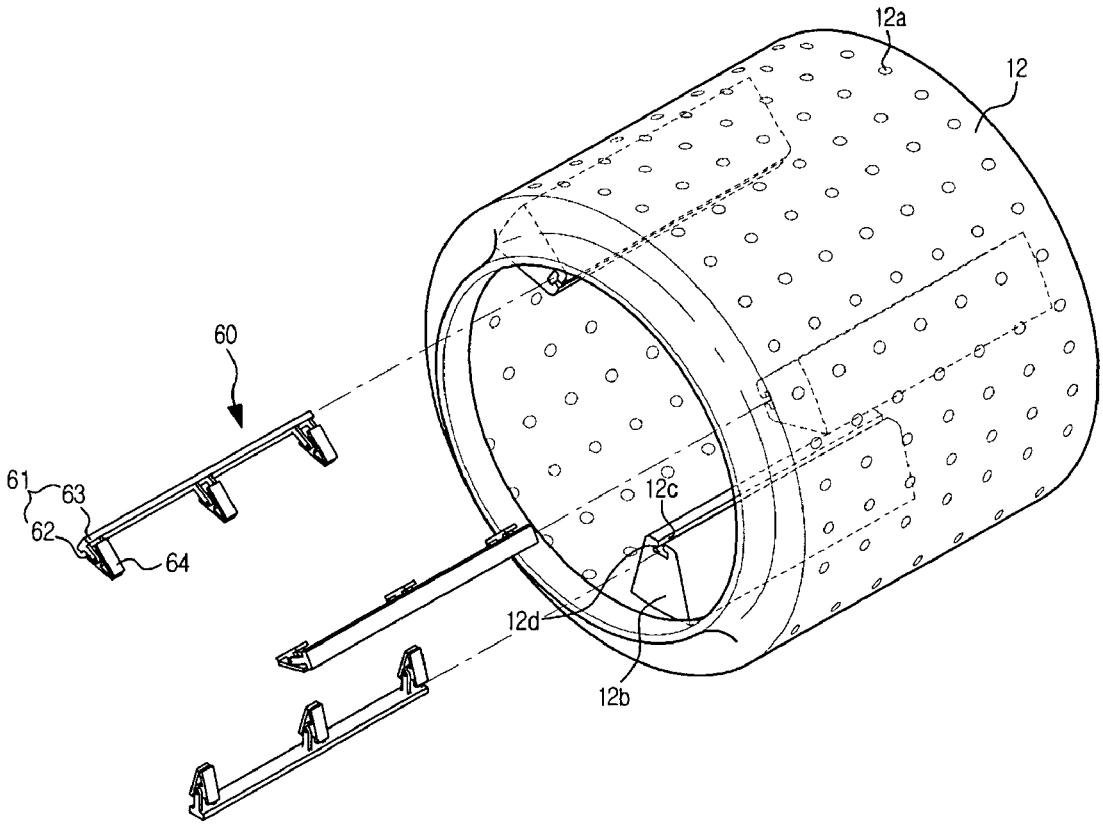
FIG. 4 is a perspective view illustrating fixing units of the drum washing machine in accordance with an embodiment of the present invention.

FIG. 4 is a perspective view illustrating fixing units of the drum washing machine in accordance with an embodiment of the present invention.

Fixing units 60 serve to detachably attach a cleaning member 50 to the drum 12. For this reason, each of the fixing units 60 includes a first fixing portion 61 connected to the drum 12, and second fixing portions 64 connected the first fixing portion 61 to hold the cleaning member 50. The first fixing portion 61 includes a first fixing body 62 inserted into the guide portion 12*c* of the corresponding one of the lifters 12*b*, and first engaging pieces 63 respectively inserted into the engaging holes 12*d* of the corresponding one of the lifters 12*b*. The first fixing portion 61 is made of an elastic material so that the first fixing portion 61 can be slid from the front part to the rear part of the corresponding one of the lifters 12*b* to be connected to the corresponding one of the lifters 12*b*. That is, since the diameter of the opening of the drum 12 is smaller than the diameter of the inside of the drum 12, when the first fixing portions 61 slide into the lifters 12*b*, the first fixing portions 61 are elastically deformed, and thus, easily connected to the lifters 12*b*.

Each of the second fixing portions 64 is tweezers having a tip split into two pieces to hold the cleaning member 50. The above shape of the tweezers is apparent to those skilled in the art, and thus, a detailed description thereof will be omitted.

Figure 5:
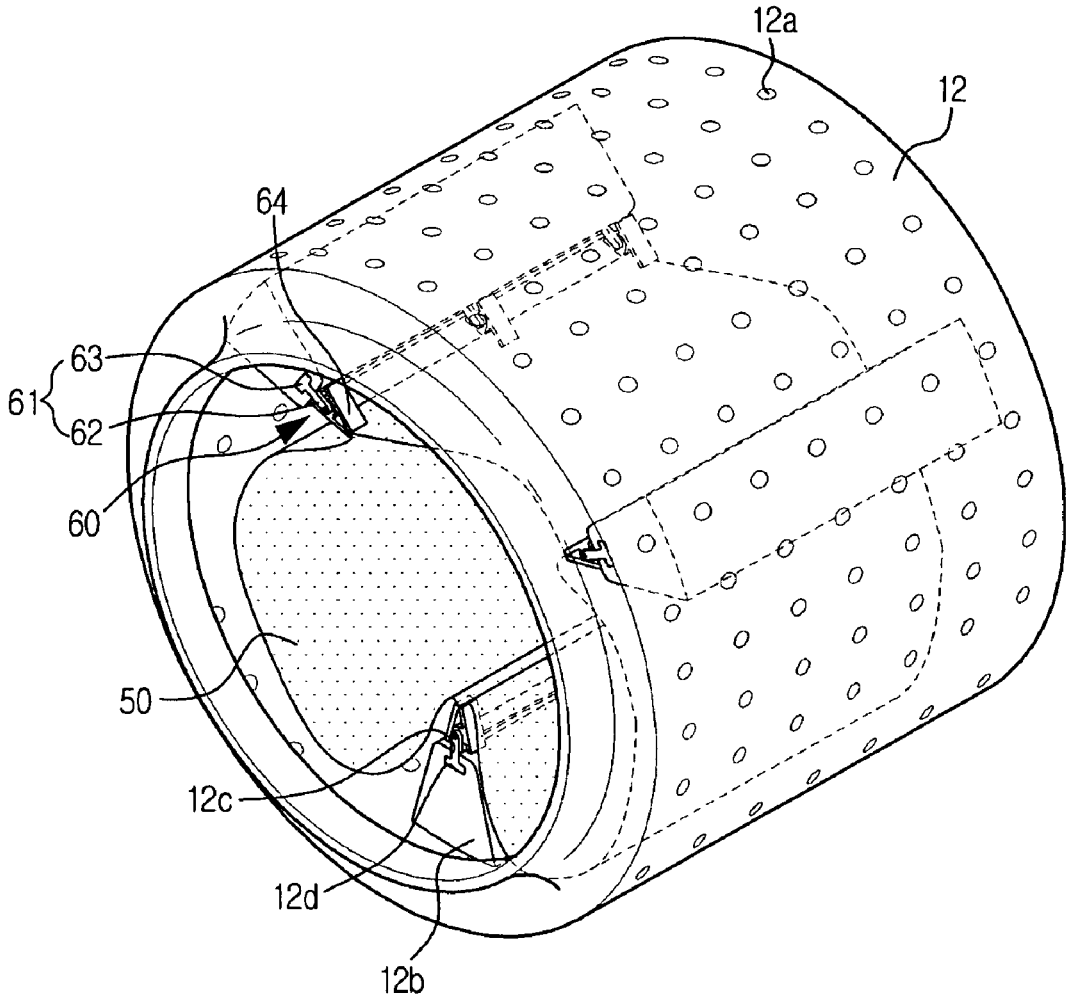
FIG. 5 is a perspective view illustrating a cleaning member installed in a drum of the drum washing machine in accordance with an embodiment of the present invention.

FIG. 5 is a perspective view illustrating the cleaning member installed in the drum of the drum washing machine in accordance with an embodiment of the present invention.

As shown in FIG. 5, in one embodiment, the cleaning member 50 contacting laundry to dry-clean the laundry without water is installed in the drum 12 of the drum washing machine of the present invention. The cleaning member 50 is made of a synthetic fiber having excellent washability and absorptiveness. For example, the cleaning member 50 is made of microfiber.

Microfiber has a three-dimensional structure of an ultrafine thread having a diameter of 1/100 of that of a hair. Microfiber having the above structure rapidly absorbs contaminants only due to a property obtained by the micro diameter thereof without a separate treatment for increasing the absorptiveness, and thus, has excellent washability and high absorptiveness due to a capillary action of many fine pores formed through the microfiber, and attracts large amounts of dirt and moisture due to the increase of the surface area of the microfiber. In addition to the excellent washability and absorptiveness, the microfiber has antibiosis and durability.

The cleaning member 50 made of microfiber is held by the second fixing portions 64, and the first fixing portions 61 connected to the second fixing portions 64 are connected to the drum 12. Thereby, the cleaning member 50 is mounted on the inner wall of the drum 12. Accordingly, when the drum 12 is rotated under the condition that laundry is put into the drum 12 and the cleaning member 50 are mounted on the inner wall of the drum 12, the cleaning member 50 contacts the laundry in the drum 12, and absorbs contaminants stuck to the laundry by means of the washability and the absorptiveness of the cleaning member 50, thereby refreshing the laundry.

Further, the cleaning member 50 is not fixed to the inner wall of the drum 12, but may be put into the drum 12 to be rotated together with the laundry. Then, when the drum 12 is rotated, the cleaning member 50 contacts the laundry, thereby dry-cleaning the laundry. In this case, no separate fixing unit for fixing the cleaning member 50 is required, and thus, the cleaning member 50 can be conveniently used.

Figure 6:
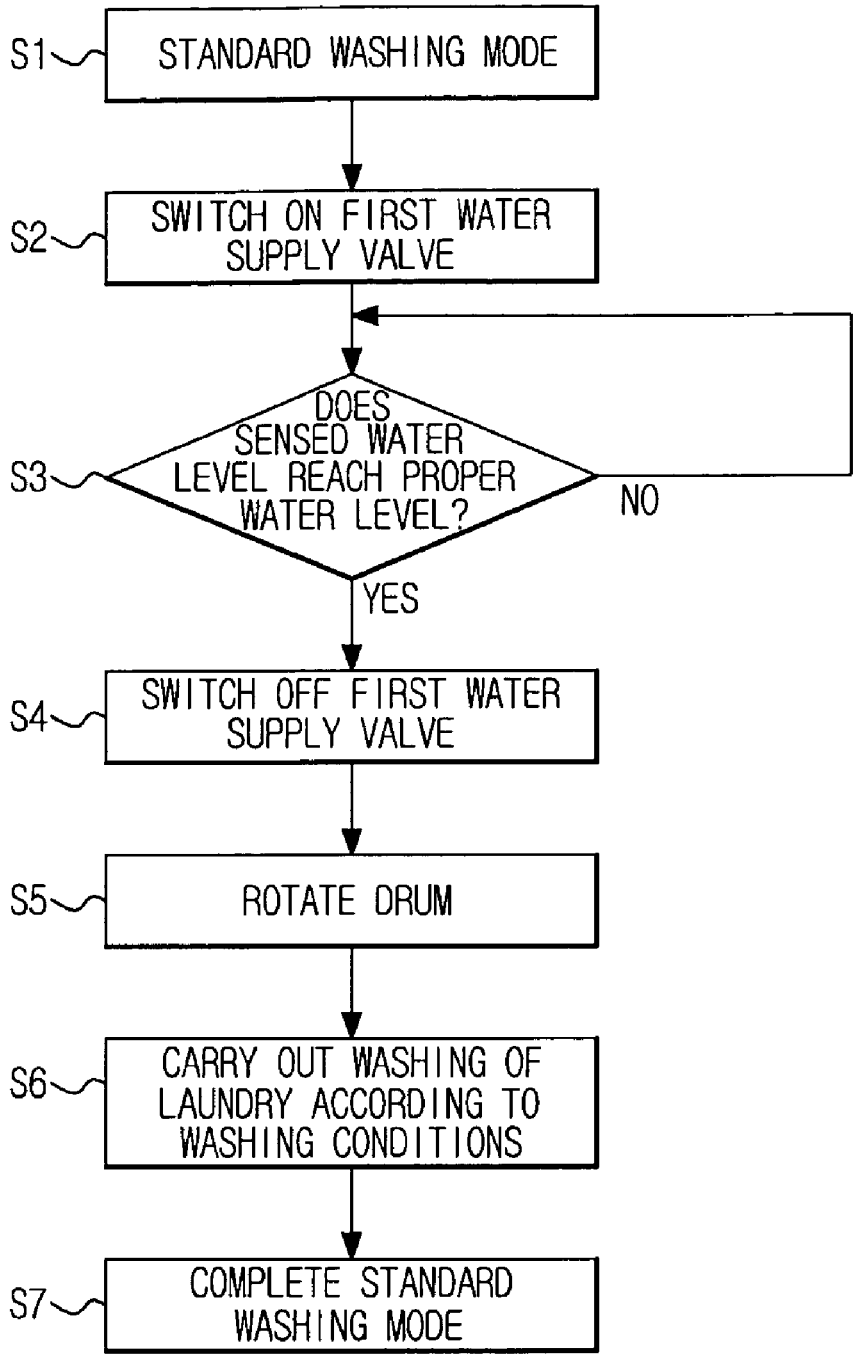
FIG. 6 is a flow chart illustrating a wet washing method of the drum washing machine in accordance with an embodiment of the present invention.

FIG. 6 is a flow chart illustrating a standard washing method of the drum washing machine in accordance with an embodiment of the present invention.

As shown in FIG. 6, a wet washing method, i.e., a washing method using water, of the drum washing machine of the present invention will be described. Hereinafter, the wet washing method is referred to as a standard washing method.

To wash laundry using water, a user selects a standard washing mode on a control panel (not shown) (S1). When the standard washing mode is selected, a microcomputer (not shown) switches the first water supply valve 35 on, and thus, washing water is supplied to the detergent supply device 27 through the first water supply pipe 34 (S2). Then, the washing water containing a detergent supplied from the detergent supply device 27 is supplied to the tub 11 through the washing water supply pipe 36. A water level sensor (not shown) senses the level of the washing water in the tub (S3), and the microcomputer (not shown) determines whether the sensed level of the washing water reaches a proper water level, and controls the first water supply valve 35 according to the result of the determination (S4). That is, when it is determined that the sensed level of the washing water reaches a predetermined water level, the first water supply valve 35 is switched off, and when it is determined that the sensed level of the washing water has not reached the predetermined water level, the first water supply valve 35 is switched on. When the first water supply valve 35 is switched off, the drum 12 is rotated (S5), and then the washing of the laundry is carried out according to the washing conditions (S6). That is, a washing operation, a rinsing operation, and a dehydrating operation are sequentially performed. Thereby, the standard washing mode is completed (S7).

Figure 7:
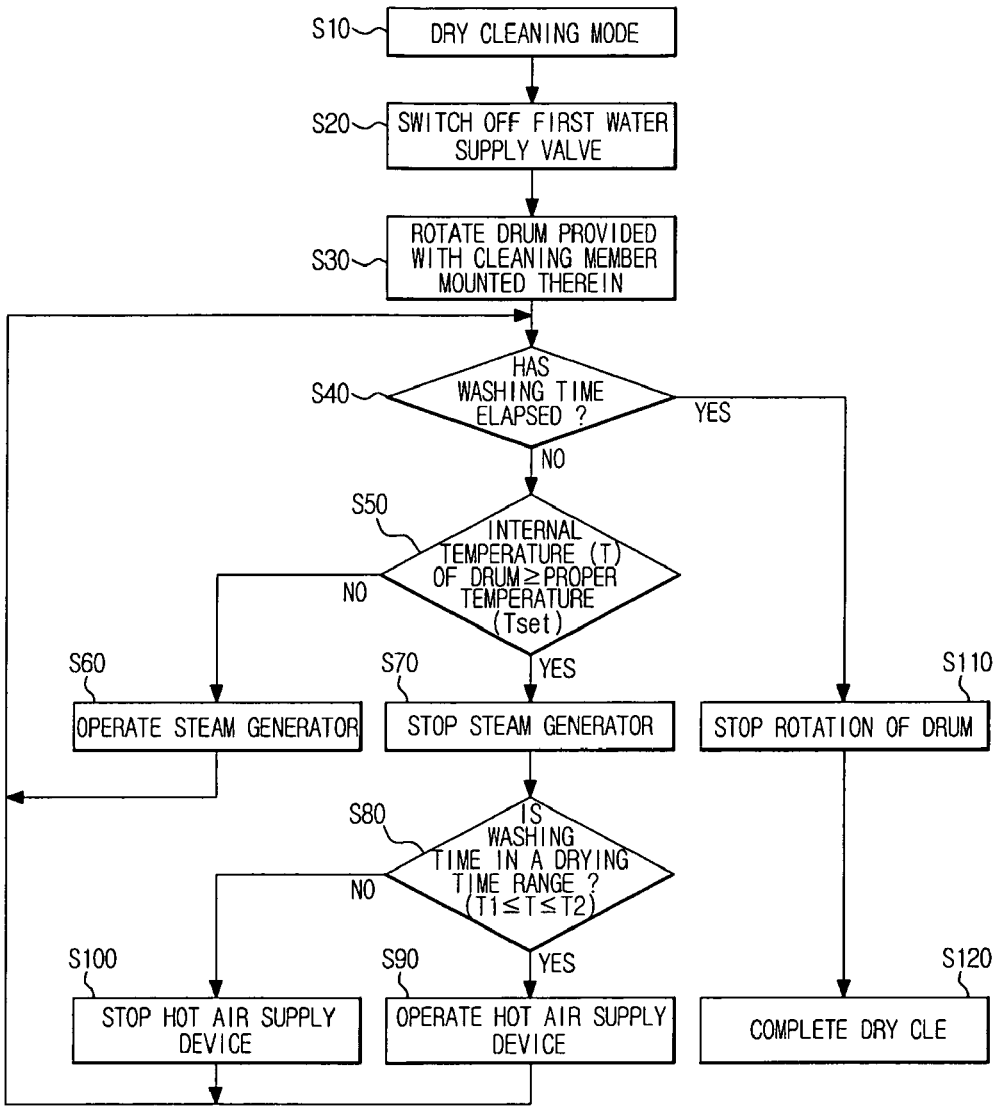
FIG. 7 is a flow chart illustrating a dry washing method of the drum washing machine in accordance with an embodiment of the present invention.

FIG. 7 is a flow chart illustrating a dry washing method, i.e., a dry-cleaning method, of the drum washing machine in accordance with an embodiment of the present invention. Hereinafter, the dry-cleaning method will be described with reference to FIG. 7.

To dry-clean laundry, a user selects a dry-cleaning mode on a control panel (not shown) (S10). When a microcomputer (not shown) recognizes the dry-cleaning mode, the first water supply valve 35 is switched off, and thus, washing water is not supplied to the tub 11 during the dry-cleaning washing of the laundry (S20). Thus, since water is not used when the laundry is washed by dry-cleaning, it is possible to prevent the laundry from being shrunk and deformed.

Thereafter, the drum 12 provided with the cleaning member 50 mounted therein is rotated (S30). Then, the cleaning member 50 made of micro fiber contacts the laundry in the drum 12, and dry-cleans and absorbs contaminants stuck to the laundry.

To increase the washability and absorptiveness of the cleaning member 50, dirt stuck to the laundry must be soaked in moisture in an initial stage of the dry-cleaning mode. For this reason, proper temperature and humidity are required. Accordingly, temperature and humidity need to be controlled. However, since temperature and humidity are related to each other, to reduce expenses, only temperature is controlled. Therefore, the microcomputer (not shown) measures the internal temperature (T) of the drum 12 through the temperature sensor 26 installed at the outlet of the drying duct 23 during the rotation of the drum 12. An internal temperature in the drum 12 suitable to wash the laundry is set to a predetermined temperature (Tset), and it is determined whether the internal temperature (T) is lower than the predetermined temperature (Tset) (S50). When it is determined that the internal temperature (T) is lower than the predetermined temperature (Tset) (T<Tset), the steam generator 40 is operated (S60), and when it is determined that the internal temperature (T) is greater than or equal to the predetermined temperature (Tset) (T≧Tset), the steam generator 40 is stopped (S70). The steam generator 40 generates steam to soak the laundry in steam in the initial stage of the dry cleaning mode, thus, assisting the cleaning member 50 to effectively dry-clean the laundry.

The hot air supply device 20 serves to supply hot air to the inside of the drum 12 in a last stage of the dry-cleaning mode to eliminate moisture from the laundry and provide a deodorizing effect. It is then determined whether a washing time (t) is in a drying time range (t1 to t2; t1≦t≦t2) (S80). When it is determined that the washing time (t) is in the drying time range (t1 to t2; t1≦t≦t2), the hot air supply device 20 is operated (S90), and when it is determined that the washing time (t) is not in the drying time range (t1 to t2; t1≦t≦t2), the hot air supply device 20 is stopped (S100). The microcomputer determines the drying time range (t1 to t2; t1≦t≦t2) based on the washing time (t), which is set according to the kind and amount of the laundry.

Then, it is determined whether the washing time (t) has elapsed (S40). When it is determined that the washing time (t) has elapsed, the rotation of the drum 12 is stopped (S110), and the dry-cleaning mode is completed (S120).

As apparent from the above description, the present invention provides a drum washing machine and a washing method thereof, in which both wet washing and dry cleaning are carried out so that laundry can be dry-cleaned at home.

Further, a cleaning member made of microfiber contacts laundry to be dry-cleaned, and thus, washes the laundry without water, thereby minimizing the deformation or shrinkage of the laundry.

Although embodiments of the invention have been shown and described, it would be appreciated by those skilled in the art that changes may be made in these embodiments without departing from the principles and spirit of the invention, the scope of which is defined in the claims and their equivalents.

What is claimed is:

1. A drum washing machine comprising:

a tub;

a drum rotatably provided in the tub, the drum including lifters to move the laundry;

a cleaning member contacting laundry in the drum to perform dry-cleaning of the laundry and made of microfiber; and a plurality of fixing units to detachably attach the cleaning member to the drum, each of the plurality of fixing units including a first fixing portion which is inserted into a corresponding one of the lifters, wherein the cleaning member substantially covers an entire inside circumferential surface of the drum and lifters.

2. The drum washing machine according to claim 1, wherein each of the plurality of fixing units includes a plurality of second fixing portions to hold the cleaning member.

3. The drum washing machine according to claim 2, wherein each of the second fixing portions is formed in a shape of tweezers to hold the cleaning member.

4. The drum washing machine according to claim 1, wherein:

each of the lifters includes a guide portion having a groove with a designated depth, and engaging holes formed in both ends of the guide portion with a designated depth; and the first fixing portion includes a first fixing body inserted into a corresponding one of the guide portions, and first engaging pieces inserted into the engaging holes.

5. The drum washing machine according to claim 1, wherein the first fixing portion is made of an elastic material.

6. The drum washing machine according to claim 1, further comprising a steam generator to supply steam to an inside of the drum.

7. The drum washing machine according to claim 1, further comprising a hot air supply device to spray hot air into an inside of the drum.

* * * * *